US007662528B2

(12) United States Patent
Wu et al.

(10) Patent No.: US 7,662,528 B2
(45) Date of Patent: Feb. 16, 2010

(54) CHARGE GENERATING COMPOSITION

(75) Inventors: Jin Wu, Webster, NY (US); Lanhui Zhang, Webster, NY (US); Cindy C. Chen, Rochester, NY (US); Liang-bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 268 days.

(21) Appl. No.: 11/356,151

(22) Filed: Feb. 17, 2006

(65) Prior Publication Data

US 2007/0196751 A1 Aug. 23, 2007

(51) Int. Cl.
*G03G 5/05* (2006.01)

(52) U.S. Cl. ..... 430/59.4; 430/59.1; 430/96

(58) Field of Classification Search ..... 430/59.4, 430/59.1, 96

See application file for complete search history.

(56) References Cited

U.S. PATENT DOCUMENTS

| | | | | |
|---|---|---|---|---|
| 3,121,006 | A | | 2/1964 | Middleton et al. |
| 4,265,990 | A | | 5/1981 | Stolka et al. |
| 4,286,033 | A | | 8/1981 | Neyhart et al. |
| 4,291,110 | A | | 9/1981 | Lee |
| 4,338,387 | A | | 7/1982 | Hewitt |
| 4,399,207 | A | * | 8/1983 | Sakai et al. ..... 430/58.15 |
| 5,034,295 | A | * | 7/1991 | Allen et al. ..... 430/96 |
| 5,229,242 | A | * | 7/1993 | Mahabadi et al. ..... 430/108.2 |
| 5,548,387 | A | * | 8/1996 | Fukami et al. ..... 399/314 |
| 5,585,212 | A | * | 12/1996 | Ueda ..... 430/96 |
| 6,136,485 | A | * | 10/2000 | Ishida et al. ..... 430/65 |
| 6,350,550 | B1 | | 2/2002 | Mishra et al. |
| 6,355,395 | B1 | * | 3/2002 | Zwez et al. ..... 430/271.1 |
| 6,703,449 | B1 | | 3/2004 | Hoxmeier et al. |
| 6,730,745 | B2 | | 5/2004 | Bening et al. |
| 6,913,863 | B2 | | 7/2005 | Wu et al. |
| 6,987,142 | B2 | | 1/2006 | St. Clair et al. |

OTHER PUBLICATIONS

KRATON Polymers, Material Safety Data Sheet for styrene-ethylene/butylene styrene products (Feb. 2003).*
KRATON Polymers Processing Guide (Jun. 2000).*

* cited by examiner

*Primary Examiner*—Christopher RoDee
(74) *Attorney, Agent, or Firm*—MH2 Technology Law Group

(57) ABSTRACT

A charge generating composition including at least one charge generating material, at least one polymer binder, and at least one styrene-containing copolymer is disclosed.

9 Claims, No Drawings

CHARGE GENERATING COMPOSITION

DESCRIPTION OF THE DISCLOSURE

1. Field of the Disclosure

Described herein is a charge generating composition, for example for use in forming a charge generating layer of an imaging member such as a photosensitive or photoconductive imaging member.

2. Background of the Disclosure

In the art of xerography and/or electrophotography, an imaging member is imaged by first uniformly, electrostatically charging the imaging member. The imaging member can then be exposed to a pattern of activating radiation, for example light, which selectively dissipates the charge in the illuminated areas of the imaging member while leaving behind an electrostatic latent image in the non-illuminated areas. This electrostatic latent image can then be developed to form a visible image by depositing finely divided toner particles, for example from a developer composition, on the surface of the imaging member. The resulting visible toner image can be transferred to a suitable image receiving substrate such as paper. This imaging process can be repeated many times with reusable photosensitive members.

Typical imaging members (for example, photoreceptors) can comprise a photoconductive layer comprising a single layer or composite layers. One type of composite photoconductive layer is illustrated, for example, in U.S. Pat. No. 4,265,990, which describes a photosensitive member having at least two electrically operative layers. The first layer comprises a photogenerating layer, which is capable of photogenerating holes and injecting the photogenerated holes into the second layer, which comprises a contiguous charge transport layer. Generally, where the two electrically operative layers are supported on a conductive layer, the photogenerating layer is sandwiched, between the contiguous charge transport layer and the supporting conductive layer, and the outer surface of the charge transport layer is normally charged with a uniform electrostatic charge.

Layered imaging members have been described in numerous U.S. patents, such as U.S. Pat. No. 4,265,990, the disclosure of which is totally incorporated herein by reference, wherein there is illustrated an imaging member comprised of a photogenerating layer and an arylamine hole transport layer. Examples of photogenerating layer components include trigonal selenium, metal phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

Although excellent toner images can be obtained with multilayered belt photoreceptors, it has been found that as more advanced, higher speed electrophotographic copiers, duplicators and printers continue to be developed; there is a greater demand on copy quality. A delicate balance in charging image and bias potentials, and characteristics of toner/developer, must be maintained. This places additional constraints on the quality of photoreceptor manufacturing. In certain combinations of materials for photoreceptors or in certain production batches of photoreceptor materials, localized microdefects (for example, of sizes varying from about 50 to about 200 microns) can occur. These microdefect sites appear as print defects in the final imaged copy. In charged area development, where the charged areas are printed as dark areas, the microdefect sites may print out as white spots. These microdefects are called microwhite spots. In discharged area development systems, where the exposed area (discharged area) is printed as dark areas, these microdefect sites may print out as dark spots in a white background. All of these microdefects that exhibit inordinately large dark decay are referred to as charge deficient spots (CDS). Since the microdefect sites are fixed in the photoreceptor, the spots may be registered in every cycle of the imaging member.

The type of imaging member can determine the properties of charge generating composition. For example, the charge generating composition for an organic photoreceptor (OPC) can be Newtonian. Alternatively, the charge generating composition for an active matrix (AMAT) can be non-Newtonian. A typical charge generating composition for an AMAT can comprise a charge generating pigment dispersed in a polymer binder. However, such non-Newtonian formulations may exhibit dispersion settling and aggregation of pigments. This can adversely result in charge deficient spots and other printing defects.

A stable charge generating composition, for example that can exhibit non-Newtonian, thixotropic rheology, and substantially free of aggregation of the charge generating pigments therein, is desired. Also desired is a charge generating composition that may be used in forming an imaging member exhibiting excellent quality, for example with substantial elimination of charge deficient spots, and capable of producing high quality images.

SUMMARY OF THE DISCLOSURE

In various aspects, there is disclosed a charge generating composition including at least one charge generating material, at least one polymer binder, and at least one styrene-containing copolymer.

In various aspects, there is disclosed an imaging member comprising a charge generating section therein, wherein the charge generating section comprises at least one charge generating material, at least one polymer binder and at least one styrene-containing copolymer.

In various aspects, there is disclosed an imaging member comprising a substrate; a charge generating layer; and a charge transport layer; wherein the charge generating layer comprises at least one charge generating material, at least one polymer binder and at least one styrene-containing copolymer.

Additional objects and advantages of the disclosure will be set forth in part in the description which follows, and may be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the invention, as claimed.

DESCRIPTION OF THE DISCLOSURE

The present disclosure relates generally to a composition, for example for use in forming a charge generating layer of an imaging member such as a photosensitive or photoconductive imaging member. The charge generating composition comprises at least one charge generating material, at least one polymer binder and at least one styrene-containing copolymer.

As the at least one charge generating material, any charge generating material, including known charge generating materials, can be used alone or in any suitable combination. In aspects, a charge generating material refers to a material that is capable of generating electrons and holes when subjected to radiation such as light.

As examples of charge generating materials suitable for use herein, mention may be made of metal free phthalocyanines, metal phthalocyanines such as hydroxy gallium phthalocyanine, alkoxy gallium phthalocyanine, chloro gallium phthalocyanine, chloro indium phthalocyanine, titanyl phthalocyanine, vanadyl phthalocyanine, copper phthalocyanine and the like, perylenes such as benzimidazole perylene, bisazos, perinones, quinacridones, anthanthrones, pyranthrones, indogoides, polycyclic quinones, selenium and selenium alloys, azo pigments, squaraines, mixtures thereof and the like. In aspects, the charge generating material may include hydroxy gallium phthalocyanine, alkoxy gallium phthalocyanine, chloro gallium phthalocyanine, and titanyl phthalocyanine.

In aspects, the charge generating material can be selected to have a photosensitivity of, for example, about 400 nm to about 900 nm, such as about 500 nm to about 850 nm. Photosensitivity refers to a material's response to radiation, for example light. The photosensitive material can generate. charges in the presence of light.

The charge generating material for use herein can be in particle form, for example as a pigment, and can have a size of, for example, less than about 5 μm, for example from about 0.001 μm to about 5 μm, such as from about 0.05 μm to about 1 μm or from about 0.1 μm to about 0.6 μm. Further, in aspects, the charge generating particles can be substantially free of large agglomerations, for example, above 1 μm, that is, substantially free of particles that have formed a physically and/or chemically adhered mass with adjoining particles.

As the at least one polymer binder for the composition, any suitable film forming binder can be used. Non-limiting examples of suitable polymer binders for use herein include thermoplastic and thermosetting resins such as polycarbonates, polyesters including polyethylene terephthalate, polyurethanes, polystyrenes, polybutadienes, polysulfones, polyarylethers, polyarylsulfones, polyethersulfones, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinyl chlorides, polyvinyl alcohols, poly-N-vinylpyrrolidinones, vinyl chloride and vinyl acetate copolymers, including such copolymers with maleic acid and/or anhydride, acrylate copolymers, alkyd resins, cellulosic film formers, polyamideimides, styrene-butadiene copolymers, vinylidene chloride-vinyl chloride copolymers, vinyl acetate-vinylidene chloride copolymers, styrene-alkyd resins, polyvinyl carbazoles, any mixtures thereof, and the like. The polymers can be block, graft, random or alternating copolymers. In embodiments, the polymer binder can include a vinyl chloride-vinyl acetate-maleic acid copolymer, for example such as commercially available as VMCH from Dow Chemical.

The charge generating material can be present in the polymer binder in various amounts, generally, however, from about 3% to about 90% by weight of the charge generating material can be dispersed in about 10% to about 97% by weight of the polymer binder on a solid basis, and for example from about 25% to about 80% by weight of the charge generating material can be dispersed in about 20% to about 75% by weight of the binder.

The styrene-containing copolymer for use in the charge generating composition can be any copolymer that contains at least one monomer of styrene. The copolymer can be block, random, alternating, graft, star, or brush copolymer. Non-limiting examples of styrene-containing copolymers for use herein include block or graft copolymers of the structure A-(block)-B, A-b-B-b-A or A-(graft)-B. The styrene-containing copolymer can be block copolymer of styrene and α-olefin. In aspects, the styrene-containing copolymer can be a diblock, a triblock, a tetrablock, etc. copolymer. Thus, in aspects, the styrene-containing copolymer can be comprised of rigid units, such as styrene, with the polymeric segment B being comprised of α-olefin, for example, flexible, rubber-like units such as ethylene/propylene. The molecular weight of polymeric segment A can be from about 3,000 to about 500,000, and the molecular weight of polymeric segment B can be from about 5,000 to about 1,000,000.

Examples of block copolymers include KRATON® copolymers, available from Kraton Polymers U.S. LLC, such as KRATON G1701X®, a block copolymer of styrene-ethylene/propylene, KRATON G1726®, a block copolymer of styrene-ethylene/butylene-styrene, KRATON G1652®, a block copolymer of styrene-ethylene/butylene-styrene; and STEREON ® copolymers, available from Firestone Tire and Rubber Company, such as STEREON 730A®, a block copolymer of styrene and butadiene, and the like. With KRATON G1701® the A segment could be the styrene block and the B segment could be an ethylene/propylene block. Additional non-limiting examples include block copolymers such as styrene-ethylene/butylene-styrene triblock copolymers (SEBS) such as SEBS G1641, 1650,1651, 1652, 1653, 1654, 1657, 1660, 1726, and styrene-ethylene/propylene-styrene triblock copolymers (SEPS) or styrene-ethylene/propylene diblock copolymers (SEB) such as SEPS G1701, 1702, 1730, 1740, 1770, 1780, also available from Kraton Polymers U.S. LLC.

In aspects, the styrene-containing copolymer can be represented by the following structures:

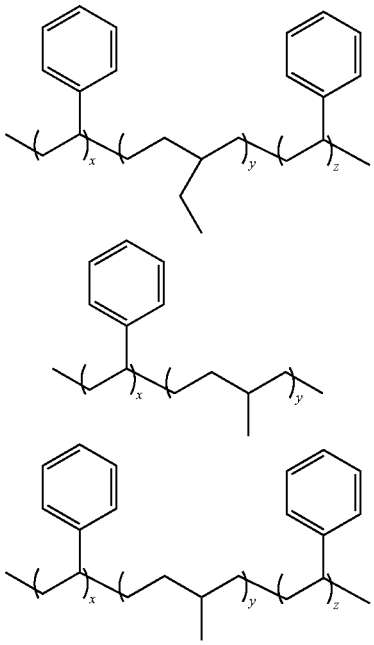

wherein x and z are each independently integers from about 1 to about 5000 and represent the degree of polymerization of the styrene block, and y is an integer of from about 1 to about 5000 and represent the degree of polymerization of either ethylene/butylene random copolymer block or ethylene/propylene random copolymer block.

The styrene-containing copolymer can be present in the charge generating composition in any desired or effective amount. In aspect, the styrene-containing copolymer can be present in an amount of from about 0.1 to about 30 wt. %, for example from about 0.1 to about 20 wt. %, and as a further example from about 0.1 to about 10 wt. % on a solid basis.

The styrene-containing copolymer can be added into the composition without solvent or together in a substantially inert solvent, for example xylene, tetrahydrofuran, and the like. Any other suitable solvents can also be used. Any suitable solvent can be utilized to dissolve and/or disperse the material in the composition. As suitable solvents, mention can also be made of n-butyl acetate, methyl ethyl ketone, methyl isobutyl ketone, cyclohexanone, toluene, methylene chloride, monochlorobenzene, and the like. Exemplary methods for adding the styrene-containing copolymer to the charge generating composition, mention may be made of (1) preparing a dispersion of the charge generating material in a polymer binder, and then adding the styrene-containing copolymer into the dispersion, and (2) preparing a dispersion of the charge generating material, a polymer binder and styrene-containing copolymer in one pot.

The styrene-containing copolymer can impart several desirable characteristics when included in a charge generating composition. For example, inclusion of the styrene-containing copolymer can. impart a non-Newtonian, for example a thixotropic or shear thinning, rheology to the composition. This may be desirable as it is generally the case that the composition undergoes stirring to ensure substantially uniform dispersion of the charge generating material in the binder, and the shear thinning at higher shear rates reduces the compositions viscosity so as to more readily achieve a substantially uniform dispersion. A further advantage of such rheology can be that upon coating of the composition, the material can increase in viscosity upon removal of the shearing conditions, thereby assisting in the fixing of the uniform dispersion in the formed coating. The styrene-containing copolymer does not result in any substantial agglomeration of the charge generating material, thereby resulting in a composition substantially free of agglomerations and can achieve a charge generating layer of high quality and a reduced tendency to generate charge deficient spots in an imaging member. The styrene-containing copolymer can also act as an anti-sagging and anti-settling agent in the composition, again assisting in the coating formed from the composition having substantially uniform properties.

The presence of the styrene-containing copolymer can achieve a charge generating composition that is able to exhibit acceptable electrical performance when formed into a charge generating layer of an imaging member. Thus, the inclusion of the styrene-containing copolymer does not appear to adversely affect the electrical performance properties of the charge generating material to an unacceptable extent.

Any other suitable or desired additives can be included within the charge generating composition.

Coating dispersions of the composition for the charge generating section of an imaging member may be formed by any suitable technique using, for example, Attritors, ball mills, Dynomills, paint shakers, homogenizers, microfluidizers and the like. Any suitable technique may be utilized to mix and thereafter apply the charge generating section composition. Typical application techniques include spraying, dip coating, roll coating, wire wound rod coating, and the like. Drying of the deposited coating may be effected by any suitable conventional technique such as oven drying, infrared radiation drying, air drying and the like. Drying is determined to be sufficient when the deposited film is no longer wet (not tacky to the touch). In aspects, dip coating may be used to apply the composition to the imaging member.

The charge generating section of the imaging member that is comprised of the at least one charge generating material, the at least one polymer binder and the at least one styrene-containing copolymer may be made to have a thickness of from about 0.05 μm to about 30 μm, for example from 0.1 μm to about 10 μm such as from about 0.1 μm to about 5 μm, although the thickness can be outside these ranges. The charge generating section thickness is related to the relative amounts of charge generating material and binder, with the charge generating material often being present in amounts of from about 5 to about 100 percent by weight. Higher binder content compositions generally require thicker layers for photogeneration. Generally, it is desirable to provide this layer in a thickness sufficient to absorb about 90 percent or more of the incident radiation that is directed upon it in the imagewise or printing exposure step. The maximum thickness of this layer is dependent primarily upon factors such as mechanical considerations, the specific photogenerating compound selected, the thicknesses of the other layers, and whether a flexible photoconductive imaging member is desired.

The charge generating section of the imaging member is a single layer in aspects, although multiple layers may also be formed. A single layer may be formed by repeated applications of the composition.

The imaging member incorporating the charge generating section derived from the charge generating composition can be, in aspects, a multilayered photoreceptor that includes, for example, a substrate, an optional conductive layer, an optional undercoat (hole blocking) layer, one or more optional adhesive layers, the charge generating layer, a charge transport layer, an optional overcoat layer, and, particularly in some flexible belt aspects, an anticurl backing layer. The imaging members may have any suitable form, for example including plates, drums, flexible belts and the like.

In aspects, the imaging member can be a flexible belt. Flexible imaging member belts may be fabricated by depositing the various layers onto long webs that are thereafter cut into sheets. The opposite ends of each sheet are overlapped and welded together to form an imaging member belt, for example by ultrasonic welding.

Additional layers of the imaging members such as photoconductors, photoreceptors and the like, for example that may be used in electrophotographic or xerographic imaging processes, will now be described.

Illustrative examples of substrate layers selected for the photoconductive imaging members, and which substrates may be known substrates and which can be opaque or substantially transparent, comprise a layer of insulating material including inorganic or organic polymeric materials, such as MYLAR®, a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a cylindrical drum, a scroll, an endless flexible belt, and the like. In an aspect, the substrate can be in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer can depend on a number of factors, including the characteristics desired and economical considerations, thus this layer may be of substantial thickness, for example over 3,000 microns, such as from about 3,000 to about 7,000 microns, or of minimum thickness, such as at least about 10 microns, providing there are no significant adverse effects on the member. In embodiments, the thickness of this layer can be from about 75 microns to about 300 microns.

If a conductive layer is used, it can be positioned over the substrate. The terms "over" and "under" in embodiments should be understood as not being limited to instances where the specified layers are contiguous. Rather, the terms refer to relative placement of the specified layers and encompass the inclusion of unspecified intermediate layers between the specified layers.

Suitable materials for the conductive layer may include aluminum, zirconium, niobium, tantalum, vanadium, hafnium, titanium, nickel, stainless steel, chromium, tungsten, molybdenum, copper, and the like, and mixtures and alloys thereof.

The thickness of the conductive layer may be from about 20 angstroms to about 750 angstroms, such as from about 50 angstroms to about 200 angstroms, for a suitable combination of electrical conductivity, flexibility, and light transmission. However, the conductive layer can, if desired, be opaque.

The conductive layer can be applied by known coating techniques, such as solution coating, vapor deposition, and sputtering. In aspects, an electrically conductive layer is applied by vacuum deposition. Other suitable methods can also be used.

If an undercoat or hole blocking layer is employed, it may be positioned over the substrate, but under the charge generating layer. The undercoat layer is at times referred to as a hole blocking layer in the art. Any suitable blocking layer capable of forming an electrical barrier to holes between the adjacent photoconductive layer and the underlying conductive layer may be utilized. Blocking layers are known and are disclosed in, for example, U.S. Pat. Nos. 4,286,033, 4,291,110 and 4,338,387, the entire disclosures of each being incorporated herein by reference.

Suitable hole blocking layers for use herein include, but are not limited to, polymers such as polyvinylbutyrals, epoxy resins, polyesters, polysiloxanes, polyamides, polyurethanes, phenolics and the like, nitrogen-containing siloxanes or nitrogen-containing titanium compounds, such as trimethoxysilyl propyl ethylene diamine, N-beta (aminoethyl) gamma-aminopropyl trimethoxy silane, isopropyl 4-aminobenzene sulfonyl titanate, di(dodecylbenezene sulfonyl) titanate, isopropyl di(4-aminobenzoyl) isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. Nos. 4,338,387, 4,286,033 and 4,291,110. Further, in aspects, the hole blocking layer may contain a metal oxide like titanium, chromium, zinc, tin and the like, dispersed in the polymer matrix, for example phenolic polymers.

The hole blocking layer may be applied as a coating by any suitable technique such as spraying, die coating, dip coating, draw bar coating, gravure coating, silk screening, air knife coating, reverse roll coating, vacuum deposition, chemical treatment and the like. For convenience in obtaining layers, the hole blocking layers may be applied in the form of a dilute solution, with the solvent being removed after deposition of the coating by techniques such as by vacuum, heating and the like. Drying of the deposited coating may be achieved by any suitable. technique such as oven drying, infrared radiation drying, air drying and the like.

The blocking layer may be continuous and have a thickness of from about 0.01 μm to about 10 μm, such as from about 0.01 μm to about 8 μm, as greater thicknesses may lead to undesirably high residual voltage.

In fabricating an imaging member, a charge generating layer can be deposited and a charge transport layer may be deposited onto the substrate surface either in a laminate type configuration where the charge generating layer and charge transport layer are in different layers or in a single layer configuration where the charge generating layer and charge transport layer are in the same layer along with a binder resin. In aspects, the charge generating layer can be applied prior to the charge transport layer.

The charge generating layer can be positioned over the hole blocking layer. If a hole blocking layer is not used, the charge generating layer can be positioned over the substrate.

The charge transport layer may comprise a charge transporting molecule, for example a small molecule, dissolved or molecularly dispersed in a film forming polymer binder. In aspects, a small molecule refers to a material such as a monomer that allows the free charge photogenerated in the charge generating layer to be transported across the transport layer. The active charge transport layer thus may comprise any suitable activating compound useful as an additive dispersed in electrically inactive polymeric materials, making these materials electrically active. These compounds may be added to polymeric materials that are incapable of supporting the injection of photogenerated holes from the generation material and incapable of allowing the transport of these holes therethrough. This will convert the electrically inactive polymeric material to a material capable of supporting the direction of photogenerated holes from the generation material and capable of allowing the transport of these holes through the active layer in order to discharge the surface charge on the active layer.

The charge transport layer may comprise from about 25 percent to about 75 percent by weight of at least one charge transporting molecule and about 75 percent to about 25 percent by weight of a polymeric film forming binder resin in which the charge transporting molecule is soluble.

Any suitable charge transporting or electrically active molecule may be employed in the charge transport layer. Typical charge transporting molecules may include, but are not limited to, for example, pyrene, carbazole, hydrazone, oxazole, oxadiazole, pyrazoline, arylamine, arylmethane, benzidine, thiazole, stilbene and butadiene compounds; pyrazolines such as 1-phenyl-3-(4'-diethylaminostyryl)-5-(4'-diethylamino phenyl)pyrazoline; aryl amines such as N,N'-diphenyl-N,N'-bis(3-methylphenyl)-(1,1'-biphenyl)-4,4'-diamine; hydrazones such as N-phenyl-N-methyl-3-(9-ethyl)carbazyl hydrazone and 4-diethyl amino benzaldehyde-1,2-diphenyl hydrazone; oxadiazoles such as 2,5-bis(4-N,N'-diethylaminophenyl)-1,2,4-oxadiazole; poly-N-vinylcarbazole, poly-N-vinylcarbazole halide, polyvinyl pyrene, polyvinylanthracene, polyvinylacridine, a pyrene-formaldehyde resin, an ethylcarbazole-formaldehyde resin, a triphenylmethane polymer and polysilane, and the like.

In aspects, the charge transporting molecule can be an aryl amine, for example such as described in U.S. Pat. No. 6,913,863 or U.S. Pat. No. 6,350,550, each of which is incorporated herein by reference in its entirety. Examples of suitable aryl amines include triphenylmethane, bis(4-diethylamine-2-methylphenyl)phenylmethane, 4'-4"-bis(diethylamino)-2',2"-dimethyltriphenylmethane, N,N'-bis(alkylphenyl)-{1,1'-biphenyl}-4,4'-diamine wherein the alkyl is, for example, methyl, ethyl, propyl, butyl, hexyl, etc., N,N'-diphenyl-N,N'-bis(alkylphenyl)-1,1-biphenyl-4,4'-diamine wherein alkyl is selected from the group consisting of methyl, ethyl, propyl, butyl, hexyl, and the like, N,N'-diphenyl-N,N'-bis(halophenyl)-1,1'-biphenyl-4,4'-diamine wherein the halo substituent is, in embodiments, a chloro substituent, and N,N'-diphenyl-N,N'-bis(3"-methylphenyl)-(1,1'-biphenyl)-4,4'-diamine, combinations thereof and the like.

Any suitable polymer binder may be employed in the charge transport layer. Typical electrically inactive polymer binders include polycarbonate, polyester, polyarylate, polyacrylate, polyether, polysulfone, and the like. Molecular weights can vary, for example from about 20,000 to about 150,000. Exemplary binders include polycarbonates such as poly(4,4'-isopropylidene-diphenylene)carbonate (also referred to as bisphenol-A-polycarbonate); polycarbonate, poly(4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate), and the like.

Any suitable technique may be utilized to mix and thereafter apply the charge transport layer coating mixture. Typical application techniques include spraying, dip coating, roll coating, wire wound rod coating, and the like. Drying of the deposited coating may be effected by any suitable technique such as oven drying, infrared radiation drying, air drying and the like.

Generally, the thickness of the charge transport layer is from about 10 μm to about 100 μm, but a thickness outside this range can also be used. A ratio of the thickness of the charge transport layer to the charge generating layer may be maintained at, for example, from about 2:1 to 200:1.

The imaging member may comprise, for example, a charge generating layer sandwiched between a conductive surface and a charge transport layer or a charge transport layer sandwiched between a conductive surface and a charge generating layer.

Optionally, an overcoat layer may also be utilized to improve resistance to abrasion. The overcoat layer is known in the art and may comprise thermoplastic organic polymers or inorganic polymers that are electrically insulating or slightly semi-conductive. Overcoat layers may be continuous and commercially have a thickness of less than about 10 μm such as from about 0.01 μm to about 10 μm.

Additionally, adhesive layers can be provided, if necessary or desired, between any of the layers in the photoreceptors to ensure adhesion of any adjacent layers. Alternatively, or in addition, adhesive material can be incorporated into one or both of the respective layers to be adhered. Such optional adhesive layers may have a thickness of about 0.001 μm to about 0.2 μm. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include film-forming polymers, such as polyester, DuPont 49,000 (available from E. I. DuPont de Nemours & Co.), VITEL PE-100 (available from Goodyear Tire and Rubber Co.), polyvinyl butyral, polyvinyl pyrrolidone, polyurethane, polymethyl methacrylate, and the like.

Also included within the scope herein are methods of imaging and printing with the imaging member described herein. These methods generally involve the formation of an electrostatic latent image on the imaging member, followed by developing the image with a toner composition comprised, for example, of thermoplastic resin, and colorant, such as pigment, subsequently transferring the image to a suitable image receiving substrate, and permanently affixing the image thereto. In those environments wherein the device is to be used in a printing mode, the imaging method involves the same aforementioned sequence with the exception that the exposure step can be accomplished with a laser device or image bar.

Processes of imaging, especially xerographic imaging and printing, including digital, are also encompassed. More specifically, the layered photoconductive imaging members can be selected for a number of different known imaging and printing processes including, for example, electrophotographic imaging processes, such as xerographic imaging and printing processes wherein charged latent images can be rendered visible with toner compositions of an appropriate charge polarity. The imaging members can be sensitive in the wavelength region of, for example, from about 500 to about 900 nanometers, and thus gas and diode lasers, light emitting diodes (LED), and broad-band light sources such as tungsten, fluorescent, and xenon lamps can be selected as the light source. Moreover, the imaging members can be useful in color xerographic applications, such as high-speed color copying and printing processes. The imaging member may be utilized in a printer, copier, fax machine, etc.

In an image forming apparatus including the imaging member, the apparatus may include at least one charging station where an imaging member is charged, at least one exposing station where a latent image is formed in the imaging member through use of an appropriate radiation source such as light, at least one developing station where the latent image is developed, for example with a toner, on the imaging member surface, and a transfer station where the image is transferred to an image receiving substrate. A cleaning station for cleaning the imaging member surface after transfer of the image to an image receiving substrate such as paper may also be included. In the apparatus, the imaging member is made to associate with each station in forming the image, for example by rotating past each station if the imaging member is in belt or drum form.

The following Examples illustrate aspects described above.

EXAMPLES

Example 1

Charge Generating Compositions

A mill base of hydroxy gallium phthalocyanine Type V (HOGaPc) (65%) and vinyl chloride-vinyl acetate-maleic acid anhydride copolymer (VMCH, Dow Chemical) (35%) in tetrahydrofuran (10 wt % solid) was first prepared via milling in Attritor for 3 hours using 1.0 mm glass beads. The mill base was let down with both solvent and styrene-containing copolymer (Kraton G1701-H, a styrene-ethylene/propylene-styrene triblock copolymer, Kraton Polymers). Two dispersions were obtained: HOGaPc/VMCH/G1701-H=65/35/10 in THF (7.5 wt % solid, real P/B ratio=59/41) and HOGaPc/VMCH/G1701-H=65/35/20 in THF (7.5 wt % solid, real P/B ratio=54/46). The dispersions exhibited shear-thinning rheology, and excellent flow visualization, such as no apparent charge generating material aggregation and flocculation, which is commonly associated with known AMAT'S non-Newtonian charge generating compositions.

A composition without a styrene-containing copolymer was also prepared and this composition exhibited a flat Theological curve with no shear thinning observed. Rheological behavior of the disclosed compositions can be finely tuned by total solid content, charge generating material/polymer binder/styrene-containing copolymer ratio, for example it can be desirable that the charge generating material/(polymer binder+styrene-containing copolymer) ratio is no less than about 50/50 for good electrical performance.

Example 2

Compositions in Devices

Photoreceptor devices were prepared with 3-Component UCL (3C UCL), a controlled charge generating composition (Newtonian HOGaPc/VMCH=65/35 in THF, 7.5 wt % solid), and the disclosed charge generating composition (non-Newtonian HOGaPC/VMCH/G1701-H=65/35/10 in THF, 7.5 wt % solid, real P/B ratio=59/41 and HOGaPC/VMCH/G1701-H=65/35/20 in THF, 7.5 wt % solid, real P/B ratio=54/46) and 27 μm charge transport layer. The 3C undercoat layer was prepared as follows: zirconium acetylacetonate tributoxide (35.5 parts), γ-aminopropyltriethoxysilane (4.8 parts) and poly(vinyl butyral) BM-S (2.5 parts) was dissolved in n-butanol (52.2 parts). The coating solution was coated via a ring coater, and the layer was pre-heated at 59° C. for 13 minutes, humidified at 58° C. (dew point=54° C.) for 17 minutes, and dried at 135° C. for 8 minutes. The thickness of the undercoat layer was approximately 1.3 μm. The charge generating layer was about 0.2 to about 0.5 μm in thickness. The charge transport layer was coated on top of the charge generating layer from a solution prepared from N,N'-diphenyl-N,N-bis(3-methylphenyl)-1,1'-biphenyl-4,4'-diamine (5 grams) and a film forming polymer binder PCZ-400 (poly(4,4'-dihydroxydiphenyl-1-1-cyclohexane, $M_w$=40,000)) available from Mitsubishi Gas Chemical Company, Ltd. (7.5 grams) was dissolved in a solvent mixture of 20 grams of tetrahydrofuran (THF) and 6.7 grams of toluene. The charge transport layer was dried at 120° C. for 40 minutes to provide the photoreceptor.

The above-prepared photoreceptor devices were tested in a scanner set to obtain photo induced discharge curves, sequenced at one charge-erase cycle followed by one charge-expose-erase cycle, wherein the light intensity was incrementally increased with cycling to produce a series of photo induced discharge characteristic curves (PIDC) from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters; the exposure light source was a 780-nanometer light emitting diode. An aluminum drum was rotated at a speed of about 61 revolutions per minute to produce a surface speed of about 122 millimeters per second. The xerographic simulation was completed in an environmentally controlled light tight chamber at ambient conditions (about 50 percent relative humidity and about 22° C.).

Almost identical PIDC curves were observed for the disclosed charge generating devices and the controlled charge generating device. Excellent short and long cycling in both A and J zone was observed for the disclosed charge generating device. Comparable print quality was observed for the disclosed charge generating devices with either thin charge transport or nominal charge transport thickness when compared with the controlled charge generating device.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A composition comprising:

at least one charge generating material;

at least one polymer binder chosen from vinyl chloride-vinyl acetate-maleic acid copolymers, and at least one styrene-containing copolymer selected from the group consisting of styrene-ethylene/propylene-styrene triblock copolymers, styrene-ethylene/propylene diblock copolymers, and mixtures thereof, wherein the at least one styrene-containing copolymer is present in the composition in an amount of from about 0.1 to about 30 wt. % on a solid basis.

2. The composition according to claim 1, wherein the at least one charge generating material is selected from the group consisting of metal free phthalocyanines, metal phthalocyanines, perylenes, bisazos, perinones, quinacridones, anthanthrones, pyranthrones, indogoides, polycyclic quinones, selenium and selenium alloys, azo pigments, squaraines, and mixtures thereof.

3. The composition according to claim 1, wherein the at least one charge generating material includes a metal phthalocyanine.

4. The composition according to claim 1, wherein the composition comprises from about 25% to about 80% by weight of the at least one charge generating material dispersed in about 20% to about 15% by weight of the at least one polymer binder.

5. An imaging member comprising a charge generating section therein, wherein the charge generating section comprises at least one charge generating material, at least one polymer binder and at least one styrene-containing copolymer selected from the group consisting of styrene-ethylene/propylene-styrene triblock copolymers, styrene-ethylene/propylene diblock copolymers, and mixtures thereof; and wherein the charge generating section comprises from about 25% to about 80% by weight of the at least one charge generating material dispersed in about 20% to about 75% by weight of the at least one polymer binder.

6. The imaging member according to claim 5, wherein the at least one charge generating material is selected from the group consisting of metal free phthalocyanines, metal phthalocyanines, perylenes, bisazos, perinones, quinacridones, anthanthrones, pyranthrones, indogoides, polycyclic quinones, selenium and selenium alloys, azo pigments, squaraines, and mixtures thereof.

7. The imaging member according to claim 5, wherein the at least one styrene-containing copolymer is present in the composition in an amount of about 0.1 to about 30 wt. % on a solid basis.

8. The imaging member according to claim 5, wherein the charge generating section has a thickness of from about 0.05 μm to about 30 μm.

9. An imaging member comprising:

a substrate;

a charge generating layer; and a charge transport layer;

wherein the charge generating layer comprises at least one charge generating material, at least one polymer binder and at least one styrene-containing copolymer selected from the group consisting of styrene-ethylene/propylene-styrene triblock copolymers, styrene-ethylenelpropylene diblock copolymers, and mixtures thereof.

* * * * *